United States Patent [19]

Kolton et al.

[11] Patent Number: 4,940,146

[45] Date of Patent: Jul. 10, 1990

[54] HANGER AND DISPLAY ARRANGEMENT FOR SUSPENDERS

[75] Inventors: Chester Kolton, Westfield; Stuart S. Spater, Livingston, both of N.J.

[73] Assignee: B & G Plastics, Inc., New York, N.Y.

[21] Appl. No.: 279,992

[22] Filed: Dec. 5, 1988

[51] Int. Cl.[5] ..... A47F 7/00

[52] U.S. Cl. ..... 211/13; 211/113; 206/296

[58] Field of Search ..... 211/13, 113, 46, 60.1, 211/133, 71; 206/296; 2/340

[56] References Cited

U.S. PATENT DOCUMENTS

| | | | |
|---|---|---|---|
| 4,714,156 | 12/1987 | Kolton et al. | 211/113 X |
| 4,718,546 | 1/1988 | Kolton et al. | 211/113 X |
| 4,759,440 | 7/1988 | Kolton et al. | 211/113 X |
| 4,765,467 | 8/1988 | Kolton et al. | 211/113 X |
| 4,768,649 | 9/1988 | Kolton et al. | 211/113 X |

*Primary Examiner*—Alvin C. Chin-Shue
*Assistant Examiner*—Sarah A. Lechok
*Attorney, Agent, or Firm*—Robin, Blecker, Daley & Driscoll

[57] ABSTRACT

A countertop suspenders display arrangement includes a countertop stand having a display rod support extending upwardly from a base to a given limited height substantially less than the full length of suspenders to be displayed. The display rod is supported by the stand at a given distance above the base, substantially less than the full length of the suspenders. A suspenders hanger is configured as a resilient, flat body of synthetic material and includes an upper recessed opening about which the body is deflectable to receive the display rod and to self-biasingly resume undeflected state to releasably ensnare the display rod. The body includes a lower portion, separated from the upper opening by a middle portion providing expanse for display of logo, size and the like. The lower portion includes laterally extending recessed openings of measure equal to or exceeding the width of the straps of the suspenders and generally central slots extending from the lower perimeter of the body into communication with the lower portion openings. The straps of the suspenders are placed in the openings by deflection of the body about the slots and the straps are positioned relative to the body such that end fittings of the straps are disposed above the base of the stand, generally equal lengths of the straps extending from opposed sides of the body toward the base.

10 Claims, 2 Drawing Sheets

HANGER AND DISPLAY ARRANGEMENT FOR SUSPENDERS

FIELD OF THE INVENTION

This invention relates generally to the marketing of suspenders and pertains more particularly to the display of suspenders in confined display spaces, such as countertops.

BACKGROUND OF THE INVENTION

In recent years, improved hangers for suspenders have become available, whereby the packaging of suspenders in cartons having a viewing window is unnecessary. One such hanger embodies an upper hook portion for application to a display rod and a flat body of synthetic material defining lower openings with slots extending to the bottom of the body. The openings are sized to receive and releasably retain end fittings of the suspenders, without need for opening of the end fittings. The suspenders extend fully lengthwise from the hanger and are removable from the hanger for inspection by a prospective buyer without need for opening the end fittings.

Hangers which display suspenders fully lengthwise are unsuited for use where display space limitations do not encompass the full length of the suspenders. Thus, instances arise, for example, countertop display applications, where desire exists for unboxed display but where a quite limited display height is available.

SUMMARY OF THE INVENTION

The present invention has as its primary object the provision of a suspenders display arrangement for use in confined display areas.

A further object of the invention is to provide a suspenders hanger for use in such confined display areas.

In attaining the foregoing and other objects, the invention provides a countertop suspenders display arrangement including a countertop stand having a display rod support extending upwardly from a base to a given limited height substantially less than the full length of suspenders to be displayed. The display rod is supported by the stand at a distance above the base somewhat more than one-half the full length of the suspenders.

A suspenders hanger is configured as a resilient, flat body of synthetic material and includes an upper portion having a recessed opening about which the body is deflectable to receive the display rod and to self-biasing resume undeflected state to releasably ensnare the display rod. The body includes a lower portion, separated from the upper portion by a middle portion, the latter providing expanse for display of logo, size and the like. The lower portion includes laterally extending recessed openings of measure equal to or exceeding the width of the straps of the suspenders and generally central slots extending from the lower perimeter of the body into communication with the lower portion openings. The straps of the suspenders are placed in the openings by deflection of the body about the slots and the straps are positioned relative to the body such that end fittings of the straps are disposed above the base of the stand, generally equal lengths of the straps extending from opposed sides of the body toward the base. With this arrangement, the full length of the suspenders is accommodated in a vertical display area which need only be slightly greater than one-half of the full length of the suspenders.

The foregoing and other objects and features of the invention will be further understood from the following detailed description of a preferred embodiment thereof and from the drawings, wherein like reference numerals identify like parts and components throughout.

DETAILED DESCRIPTION OF THE PREFERRED EMBODIMENT AND PRACTICE

Figure 2:
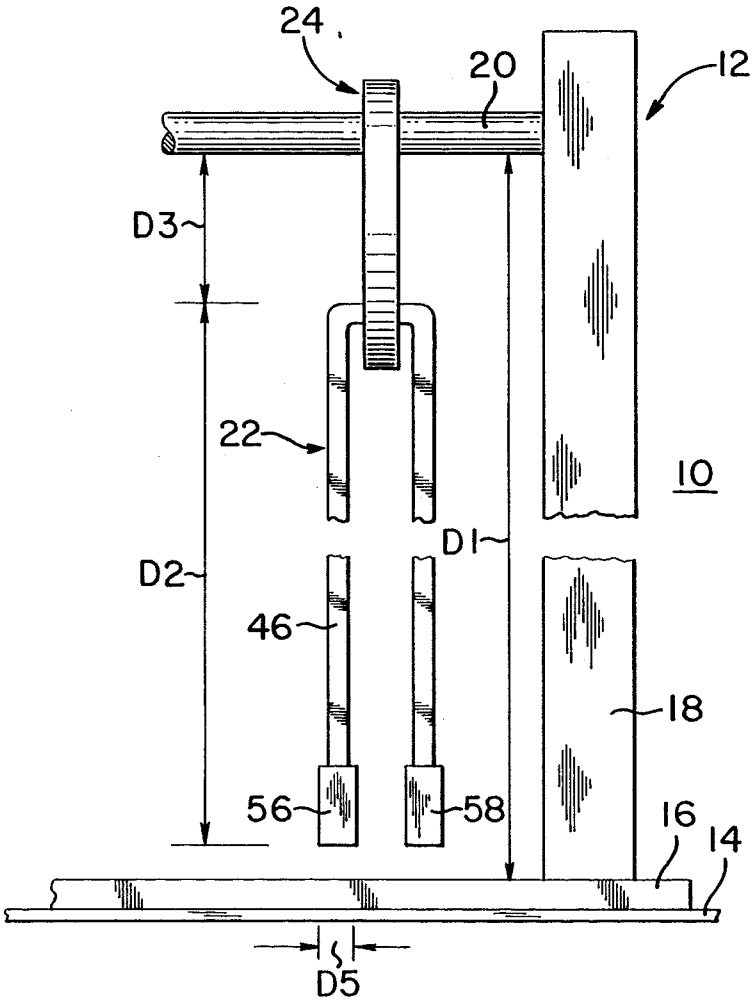
FIG. 2 is a side elevational view of the FIG. 1 display arrangement.
Figure 1:
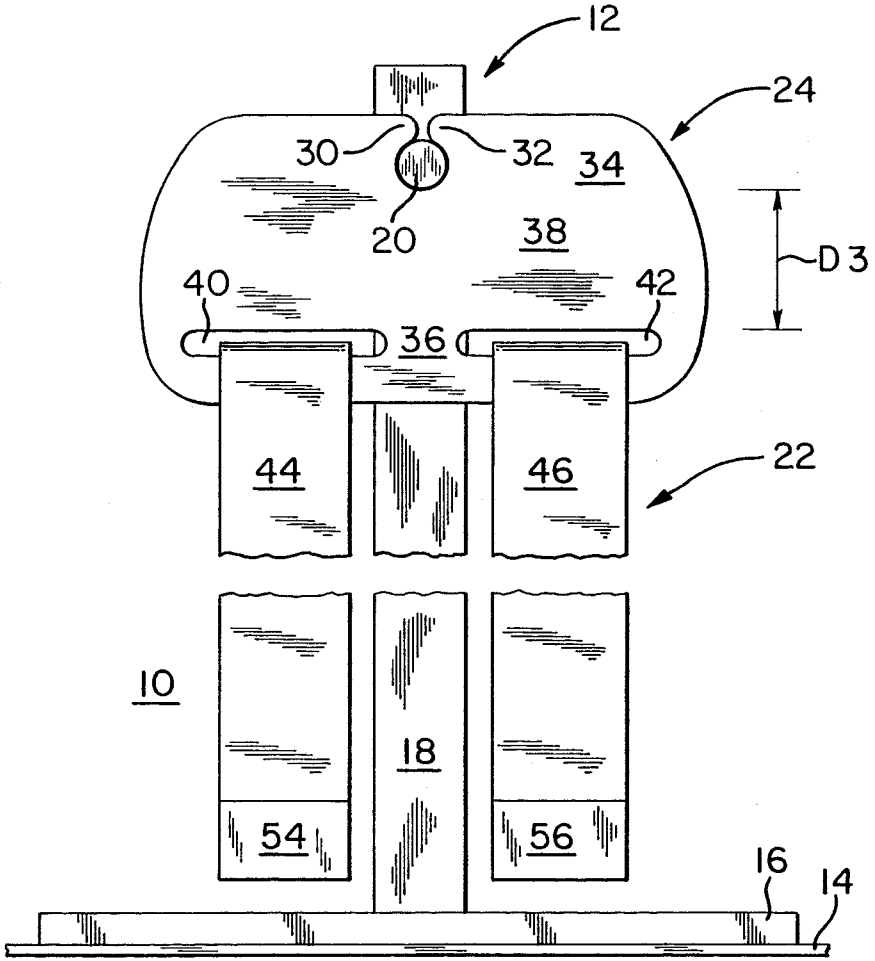
FIG. 1 is a front elevational view of a display arrangement in accordance with the invention.

Referring to FIGS. 1 and 2, countertop suspenders display arrangement 10 includes a countertop stand 12 to be supported by countertop 14 and to extend vertically thereabove. Stand 12 includes a base 16 and a display rod support 18 upstanding from base 16 to a given limited height substantially less than the full length of suspenders to be displayed. Display rod 20 is supported by the stand at a distance D1 above the base, D1 being of measure equal to about one-half the length of the suspenders (D2) plus the distance D3, which is of measure equal to the spacing between openings in the hanger now discussed.

Figure 3:
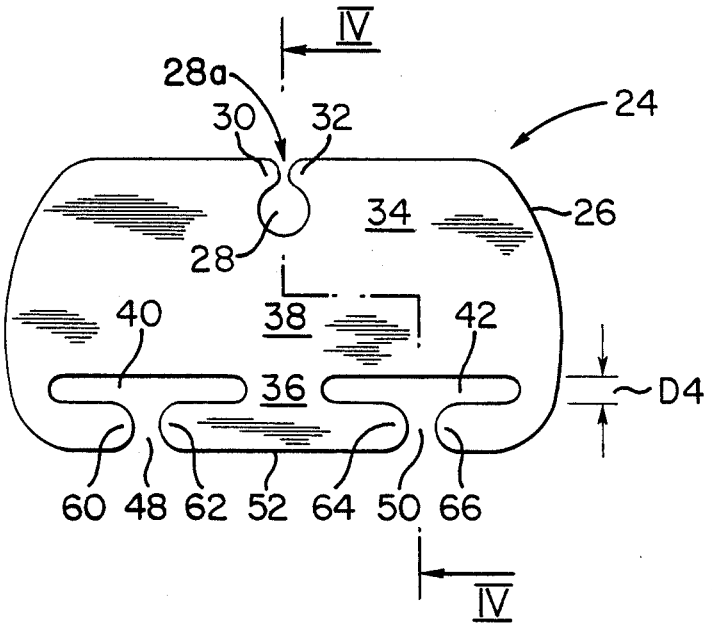
FIG. 3 is a front elevational view of the suspenders hanger of the FIG. 1 display arrangement, separately shown.
Figure 4:
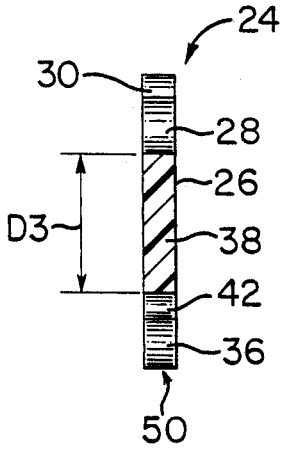
FIG. 4 is a sectional view of the FIG. 3 hanger as would be seen from broken plane IV—IV of FIG. 3.

Suspenders hanger 24, shown separately in FIGS. 3 and 4 to which reference is now also had, is configured as a resilient, flat body 26 of synthetic material, for example, molded plastic material. Body 26 includes an upper portion having a recessed opening 28 with entry slot **28*a* about which bounding body portions 30 and 32 are deflectable to receive display rod 20 and to self-biasing resume undeflected state within the plane of body 26 to releasably ensnare display rod 20**.

The body includes, contiguously with upper portion 34, a lower portion 36, which is spaced from upper opening 28 by middle portion 38, which provides expanse for display of logo, size and the like. Lower portion 36 includes laterally extending recessed openings 40 and 42 of lateral measure equal to or exceeding the width of straps 44 and 46 of suspenders 22 and generally central slots 48 and 50 extending from the lower perimeter 52 of body 26 into communication with openings 40 and 42. Distance D3 exists between opening 28 and openings 40 and 42.

Straps 44 and 46 of suspenders 22 include end fittings 54 and 56 at first ends, as seen in FIG. 1 and further fittings at second ends, that of strap 46 being seen at 58 in FIG. 2. Straps 44 and 46 are placed in openings 40 and 42 by deflection of body parts 60 and 62, bounding slot 48, and body parts 64 and 66, bounding slot 50. Upon such strap placement, body parts 60, 62, 64 and 66 self-biasingly return to common plane disposition with body 26.

The straps are positioned relative to the body such that the end fittings of the straps are disposed above the base of the stand, generally equal lengths of the straps extending from opposed sides of the body toward the base. With this arrangement, the full length of the suspenders is accommodated in a vertical display area which need only be slightly greater than one-half of the full length of the suspenders.

While the invention is directed particularly to confined display area accommodation for suspenders hanging, Hanger 24 will be seen to have utility otherwise in expanded display areas, where full length suspenders display is applicable. Thus, openings 40 and 42 may be configured with vertical extent D4 in FIG. 3 less than the depthwise dimension of fittings 54, 56 and 58, i.e., the dimension D5 in FIG. 2. Such dimensioning will preclude passage of the fittings through the openings, permitting secured and full length display of the suspenders.

Various changes may be introduced in the foregoing apparatus and modifications made in practice without departing from the invention. The particularly described and discussed preferred embodiment and method are thus intended in an illustrative and not in a limiting sense. The true spirit and scope of the invention is set forth in the following claims.

What is claimed is:

1. A countertop suspenders display arrangement including:

(a) a countertop stand having a base, a display rod and a support extending upstandingly from said base and supporting said display rod at a given distance from said base;

(b) suspenders having straps with end fittings, the full longitudinal extent of said suspenders being substantially in excess of said given distance; and (c) a suspenders hanger supported by said display rod and configured as a resilient, flat body of synthetic material, said body having (1) an upper portion defining a recessed opening about which the body is deflectable to receive the display rod and to self-biasingly resume an undeflected state to releasably ensnare the display rod, and (2) a lower portion, spaced from the upper portion and including first and second laterally extending recessed openings of measure equal to or exceeding the width of said suspenders straps and first and second slots extending from a lower perimeter of said body into respective communication with said first and second lower portion openings, said body being deflectable about each of said slots to receive said straps and to self-biasingly resume an undeflected state to releasably ensnare said straps, said straps being so disposed in said first and second lower portion openings that said end fittings of said straps collectively reside in spaced relation to said base.

2. The invention claimed in claim 1 wherein said hanger includes a middle portion contiguous with said upper portion and said lower portion and effecting such spacing thereof, said middle portion including a display area.

3. The invention claimed in claim 2 wherein said given distance exceeds one-half of said full longitudinal extent of said suspenders by approximately the vertical extent of said middle portion.

4. The invention claimed in claim 1 wherein said first and second lower portion openings are configured to have dimensions resisting passage of said strap end fittings therethrough.

5. In combination, (a) suspenders having straps with end fittings; and (b) a suspenders hanger configured as a resilient, flat body of synthetic material, said body having (1) an upper portion defining a recessed opening about which the body is deflectable to receive a display rod and to self-biasingly resume an undeflected state to releasably ensnare the display rod, and (2) a lower portion, spaced from the upper portion and including first and second laterally extending recessed openings of measure equal to or exceeding the width of said suspenders straps and first and second slots extending from a lower perimeter of said body into respective communication with said first and second lower portion openings, said body being deflectable about each of said slots to receive said straps and to self-biasingly resume an undeflected state to releasably ensnare said straps.

6. The invention claimed in claim 5 wherein said hanger includes a middle portion contiguous with said upper portion and said lower portion and effecting such spacing thereof, said middle portion including a display area.

7. The invention claimed in claim 5 wherein said first and second lower portion openings are configured to have dimensions resisting passage of said strap end fittings therethrough.

8. A suspenders hanger configured as a resilient, flat body of synthetic material, said body having (a) an upper portion defining a recessed opening about which the body is deflectable to receive a display rod and to self-biasingly resume an undeflected state to releasably ensnare the display rod, and (b) a lower portion, spaced from the upper portion and including first and second laterally extending recessed openings of measure equal to or exceeding the width of the straps of such suspenders and first and second slots extending from a lower perimeter of said body into respective communication with said first and second lower portion openings, said body being deflectable about each of said slots to receive said straps and to self-biasingly resume an undeflected state to releasably ensnare said straps.

9. The invention claimed in claim 8 wherein said hanger includes a middle portion contiguous with said upper portion and said lower portion and effecting such spacing thereof, said middle portion including a display area.

10. The invention claimed in claim 8 wherein said first and second lower portion openings are configured to have dimensions resisting passage of end fittings of said straps of said suspenders therethrough.

* * * * *